United States Patent [19]

Rohner

[11] 4,341,027

[45] Jul. 27, 1982

[54] SNOW TREATMENT APPARATUS FOR GROOMING SKIING SLOPES, TRAILS OR THE LIKE AND A METHOD OF OPERATING SAME

[75] Inventor: Karl Rohner, Herisau, Switzerland

[73] Assignee: Kempf & Co. AG Förder- und Lagertechnik, Herisau, Switzerland

[21] Appl. No.: 201,622

[22] Filed: Oct. 28, 1980

[30] Foreign Application Priority Data

Nov. 6, 1979 [CH] Switzerland ..... 9949/79

[51] Int. Cl.[3] ..... E01H 4/00

[52] U.S. Cl. ..... 37/197; 37/219; 37/221; 172/392

[58] Field of Search ..... 37/195, 10–11, 37/41, 42 R, 42 VL, 50, DIG. 3; 172/781, 783, 784, 786, 787, 392, 393, 188; 404/96, 122

[56] References Cited

U.S. PATENT DOCUMENTS

| | | | |
|---|---|---|---|
| 2,786,283 | 3/1957 | Bradley | 37/10 |
| 4,014,116 | 3/1977 | Baechler | 37/10 |
| 4,021,942 | 5/1977 | Purdy | 172/393 X |
| 4,056,328 | 11/1977 | Maxey | 404/96 |
| 4,110,919 | 9/1978 | Henrichon | 37/10 |

FOREIGN PATENT DOCUMENTS

| | | | |
|---|---|---|---|
| 2903512 | 8/1979 | Fed. Rep. of Germany | 37/10 |

*Primary Examiner*—E. H. Eickholt
*Attorney, Agent, or Firm*—Werner W. Kleeman

[57] ABSTRACT

At least one trailing scraper member freely swingable within a vertical plane is provided, which has a scraper blade and a scraper base disposed at an acute angle relative to the blade. The angle of adjustment of the scraper member relative to the snow surface over which the device travels is adjustable, so that the scraper member either removes snow from the snow surface or slides over same. Associated with the scraper member is a scooping device limited by side walls and by a shield which can be lifted or lowered, in order to collect the snow provided by the scraping member and to transport same to another location and discharge same on lifting of the shield. In order to facilitate the discharge of snow accumulated within the scoop and to provide the shield with a further utility, the shield is curved in arcuate fashion about a generally horizontal axis perpendicular to the direction of travel of the device and is selectively attached to an arm either with its concave face or with its convex face turned in the direction of travel of the device. In the first case, the shield serves as a closing gate of the scoop device. In the second case the shield is utilized as a grading shield or blade disposed behind the trailing end of the scraping device. The advance in the art is in a more versatile application and in an improved performance when grooming wet snow surface.

23 Claims, 7 Drawing Figures

SNOW TREATMENT APPARATUS FOR GROOMING SKIING SLOPES, TRAILS OR THE LIKE AND A METHOD OF OPERATING SAME

BACKGROUND OF THE INVENTION

The present invention relates to a snow treatment apparatus for grooming skiing trails, slopes or the like as the apparatus travels on the treated surface, with at least one trailing scraper member freely swingable in a vertical plane, said scraper member including a scraper blade and a normally downwardly facing scraper base adjacent to the former and disposed at an acute angle relative to same, the angle adjustment of the scraper base relative to the treated snow surface being adjustable from a working position in which the scraper member scrapes snow off the surface, to a sliding position, in which the scraper base slides on the treated surface, a scoop being associated with the scraper member and being limited by two upright side walls parallel with the direction of travel of the apparatus, and by at least one shield adapted to be lowered towards and lifted away from the scraper member by means of at least one lifting arm in order to collect within the scoop the snow removed by the scraper member, to transport same and then to discharge same. The art to which the present invention relates can also be defined as an apparatus adapted to travel on a snow surface for grooming the surface of skiing slopes, trails or the like, having at least one trailing scraper secured to pulling means, said pulling means being pivotal about a horizontal axis perpendicular to the direction of travel, said scraper being provided with a scraper blade and including means for adjusting the angle at which the blade engages the snow surface, the device being provided with a shield disposed at the trailing end of the scraper end and connected to the pulling means.

The device of such type is well known in the art. Even though the utility of the known device is uncontested, its use, particularly on wet snow surfaces, that is to say, in a specific, relatively heavy and tacky snow, there are certain limits of application. If, under such circumstances, the entire scoop space is filled with snow, the accumulated snow mass changes into a monolythic block which makes it difficult to raise the shield, and even with a raised shield, is difficult to be discharged from the scoop area. Moreover, the shield of the known device is of a planar configuration and is used solely as a closure gate of the scoop space.

In another known comparable device, the shield is formed by an upwardly bent front end of a sledge. Although in this device it is possible to adjust the angle of the scraper member to adjust the depth of engagement, the sledge is pivotally secured to a towing arrangement, is disposed at a level which remains the same relative to the level of the scraper blade. The reason why this is disadvantageous is in that the trailing sledge, particularly when working with large volumes of snows engaged by the scraping blade, no longer spreads the snow lifted by the scraper. Instead, the sledge is caused by the accumulated snow to raise and to bring the scraper out of engagement with the groomed surface.

It is therefore, on the one hand, an object of the invention to provide a device of the above type, whose application is by far less dependent on the properties of the snow contained in the treated snow surface and wherein the shield can be allocated an additional function. On the other hand, the proposed device is to enable in all cases an ideal spreading or grading and solidifying of the snow surface over which the device travels.

SUMMARY OF THE INVENTION

In general terms, the present invention provides, in one aspect thereof, a snow treatment apparatus for grooming skiing trails, slopes or the like as the apparatus travels on the treated surface, with at least one trailing scraper member freely swingable in a vertical plane, said scraper member including a scraper blade and a normally downwardly facing scraper base adjacent to the former and disposed at an acute angle relative to same, the angle of the scraper base relative to the treated snow surface being adjustable from a working position in which the scraper member scrapes snow off the surface, to a sliding position, in which the scraper base slides on the treated surface, a scoop being associated with the scraper member and being limited by two upright side walls parallel with the direction of travel of the apparatus, and by at least one shield adapted to be lowered towards and lifted away from the scraper member by means of at least one lifting arm in order to collect within the scoop the snow removed by the scraper member, to transport same and then to discharge same; wherein the shield is arcuately curved about a generally horizontal axis extending transversely of the direction of travel of the apparatus, whereby the shield has a convex face and a concave face, said shield being adapted for securement to the respective arm in selective fashion either with its concave or with its convex face turned in the direction of travel of the apparatus.

In another aspect of the present invention, an apparatus is provided which is adapted to travel on a snow surface for grooming the surface of skiing slopes, trails or the like, having at least one trailing scraper secured to pulling means, said pulling means being pivotal about a horizontal axis perpendicular to the direction of travel, said scraper being provided with a scraper blade and including means for adjusting the angle at which the blade engages the snow surface, the device being provided with a shield disposed at the trailing end of the scraper and connected to the pulling means, wherein the pulling means includes an elbow lever comprised of a front link, a rear link, an elbow joint pivotally connecting the links, and adjustment means for maintaining the links in a selectively adjusted angular position, the forward link being pivotally secured for movement about a normally horizontal, transverse pivot axis disposed at the end of the front link remote from the elbow joint and located at a leading end of the elbow lever relative to the travel of the device, elevation adjustment means for selectively adjusting the level of the pivot axis; an extension member protruding rearwards from the front link over the elbow joint and carrying a trailing end thereof, a shield of the type of a grading blade having a lower spreading edge, said scraper being secured to said rear link, whereby said scraper blade and said spreading edge can swing in common about said pivot axis.

In another aspect of the present invention, a method is provided of operating the device described in the preceding paragraph, said method being characterized in that the speed of travel and the elevation of said scraper relative to the ground and relative to the elevation of the spreading edge are so adjusted that a layer of snow is cut off from the surface by the scraper, caused to impinge upon the shield and, eventually deposited on the ground and slidingly pressed onto the surface of the groomed slope, trail or the like.

In a yet further aspect of the present invention, apparatus is provided for grooming the surface of snow on skiing slopes, trails or the like, of the type adapted for movement on the groomed surface in a predetermined direction, said apparatus including, in combination, a generally transverse scraper means including a downwardly and forwardly sloping, transverse scraper edge section at a leading end and a generally flat base section normally facing the ground and disposed at an acute angle relative to said edge section; adjustment means for selectively adjusting the position of said scraper means from a scraping position wherein the base section is generally parallel with the ground and the edge section scrapes off a layer of snow from the ground surface, to a sliding position, wherein the edge section is disposed at vertical spacing above the groomed surface and the base section is sloped downwardly and rearwards for sliding on the surface; snow scoop means comprised of a pair of opposite upright side walls generally parallel with said predetermined direction, and a transverse trailing end walls means cooperative with the side walls and disposed rearwards of the scraper edge section to define a space for collecting snow removed from the surface by said scraper edge section for transport of same to a predetermined location; lifting means for selectively lifting or lowering said trailing end wall means to open or close said space, respectively; said end wall means having the shape of a generally rectangular shield having a generally straight and normally horizontal first edge and a generally straight and normally horizontal second edge, said horizontal edges extending transversely of the apparatus, and arcuately curved side edges oriented such that one surface of the wall means is convex and the other surface thereof is concave relative to an axis of curvature extending transversely with respect to said movement; mounting means for securing said shield to said lifting means in selectively alternate fashion with the said axis of curvature disposed ahead of or behind the shield relative to said predetermined direction, said shield sloping downwardly and rearwards when said axis of curvature is disposed behind the shield.

The present invention can broadly be also defined as being an apparatus for grooming the surface of snow on skiing slopes, trails or the like, comprising, in combination: a frame for movement of the device along the surface, in a predetermined direction; scraper means mounted on said frame means and extending transversely relative to the predetermined direction, generally parallel with the snow surface; said scraper means having a downwardly and forwardly sloping snow scraping surface; spreading shield means adapted to be mounted on said frame and including a slower edge portion extending transversely with respect to the predetermined direction, at a location rearwards of said scraper means; said scraper means being operatively associated with control means for selectively adjusting the angle of engagement of the scraper means with the surface of the snow thus controlling the depth of a snow layer engaged by the scraper means; mounting means for selectively securing said shield means to said frame with said lower edge maintained at a predetermined level relative to the level of said scraper means;

means for a generally free, trailing pivotal securement of the scraper means and of said shield means to the frame for a generally free swinging movement in common about a common, transverse, generally horizontal pivot axis.

BRIEF DESCRIPTION OF DRAWINGS

The features and advantages of the present invention will become apparent from the following description of preferred exemplary embodiments with reference to the accompanying drawings, wherein.

DESCRIPTION OF PREFERRED EMBODIMENTS

Figure 2:
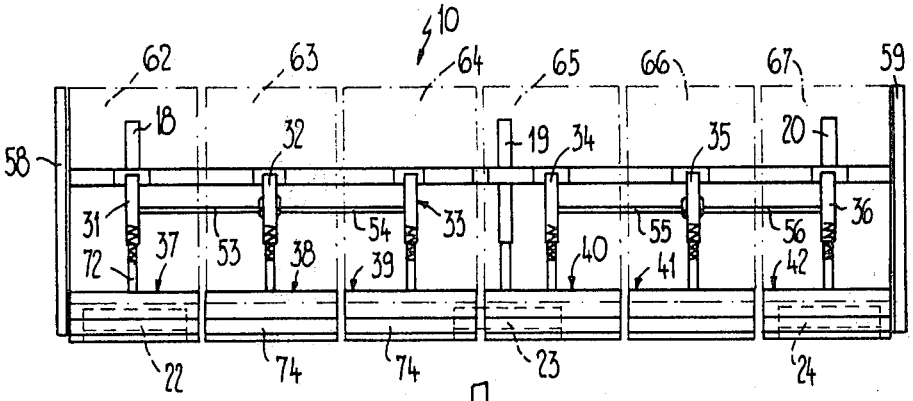
FIG. 2 is an end view in the direction of arrow II in FIG. 1, FIGS. 3, 4, and 5 are diagrammatic representations in section along the line III—III of FIG. 1 in different operative positions of the device.
Figure 3:
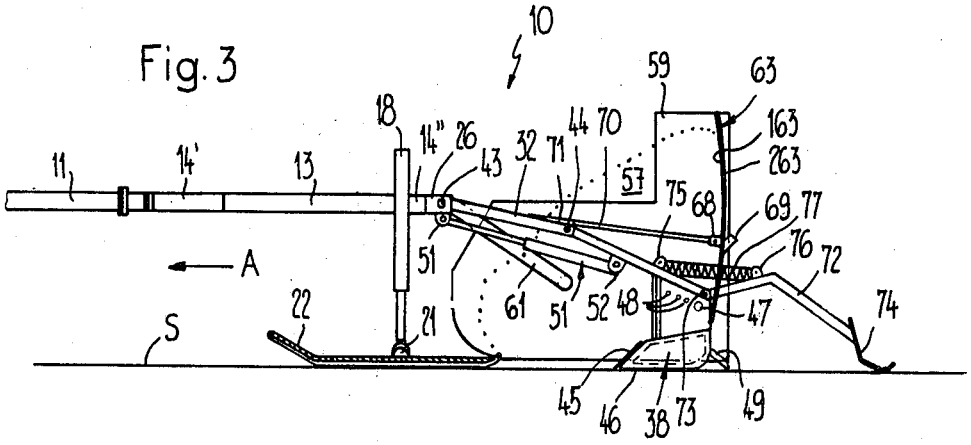
Figure 4:
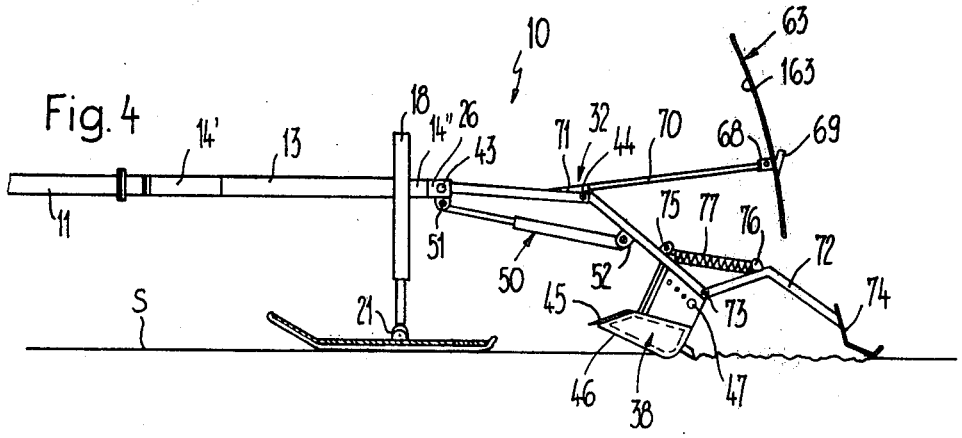
Figure 5:
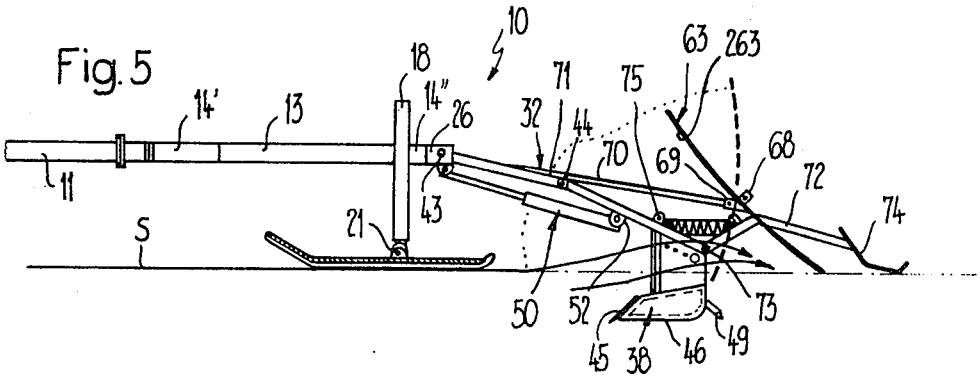

The device 10 shown in FIGS. 1–6 is provided with a tow frame 12 adapted to be secured to a towing vehicle (not shown), by a rod 11. The towing frame 12 is formed from two L-shaped frame sections 14, 15, and by diagonal struts 13 the shanks 14'15' of which are disposed generally parallel with the direction A of travel and are connected with each other by means of hinges 16, 17 having a hinge axis generally parallel with the direction of travel of the device. The other shanks 14", 15" extend at right angles to the aforesaid shanks 14', 15' and are generally parallel with respect to the ground over which the device travels. For this purpose, the level of the shanks 14", 15", as shown particularly in FIGS. 3–5, is adjustable by hydraulic leg means 18, 19, 20. The legs themselves are each provided at the lower end thereof with a pivot 21 (FIGS. 3–5) securing same to a skid 22, 23 and 24 to thus support the frame on the processed snow surface S.

On each of the shanks 14", 15" is fixed, at a uniform lateral spacing over the entire width of the device, a plurality of pairs of pivot brackets 25–30. The elements thus far described show a device which is to a substantial degree similar to that disclosed in DE-OS No. 26 27 893 published on Oct. 13, 1977.

On each of the pivot brackets 25–30, is pivotally secured, by an elbow lever 31–36 (also referred to as "link means"), a scraper member 37–42 which is practically freely swingable about an axis 43 disposed perpendicularly to the direction A of travel and parallel to the snow surface S travelled over. The pivot axes defined on the one hand by the pivot brackets 25–27, and on the other hand, by pivot brackets 28–30 are generally aligned.

The structure of the link means forming the elbow lever and of the scraping member will now be described with reference to FIGS. 3–5 wherein a typical arm lever and the scraping member of the arm lever representative of all such elements within the machine (the central element pivotally secured to the shank 14" is shown) and the cooperating scraper member 38 are shown. All elbow levers and scraping elements are of generally the same structural configuration.

The forward or first link of the elbow lever 32 is pivotally secured at its leading end to a pivot bracket 26 by a pivot pin 43. The elbow joint is referred to with reference numeral 44. In the region of the free end of the rear or second link of the elbow lever is fixedly secured to the scraper member 38 which itself contains a scraper blade 45 and a scraper base 46 disposed at an acute angle relative to the blade. In the shown embodiment, the scraper member 38 is linked, by a pivot pin 47, to the rear link of the elbow lever 32, and fixed in its position by a shearing bolt (not shown) passing through one of the bores 48. This securement of the scraper member 38 to the rear link of the respective elbow lever is also described in the aforesaid DE-OS No. 26 27 893 which is incorporated herein by reference.

At the rear or trailing end of the scraper member 38 are disposed breaker teeth 49 the free ends or tips of which are disposed approximately within the plane of the scraper base 46.

The folding or extension state of the link means 32 is provided by an adjustable mechanism also generally referred to as "control means." In the shown embodiment, such mechanism is comprised of a hydraulic piston-cylinder unit 50 (controlled from a towing vehicle, not shown), the piston rod of which is linked over a pivot boss 51 to the bracket 26 or to the shank 14'', the cylinder of same being pivotally secured at 52 to the rear link of the elbow lever 32. In the foregoing case, only levers 32 and 35 (see FIG. 1) are shown with one such piston-cylinder unit. The degree of extension of the elbow lever is transformed to the immediately adjacent elbow lever 31, 33 or 34, 36 respectively, over torsion rods 53, 54, 55, 56 (FIG. 1). by which the rear links of the adjacent elbow levers 31, 32 and 33, respectively, and 34, 35 and 36, respectively, are connected with each other.

Figure 1:
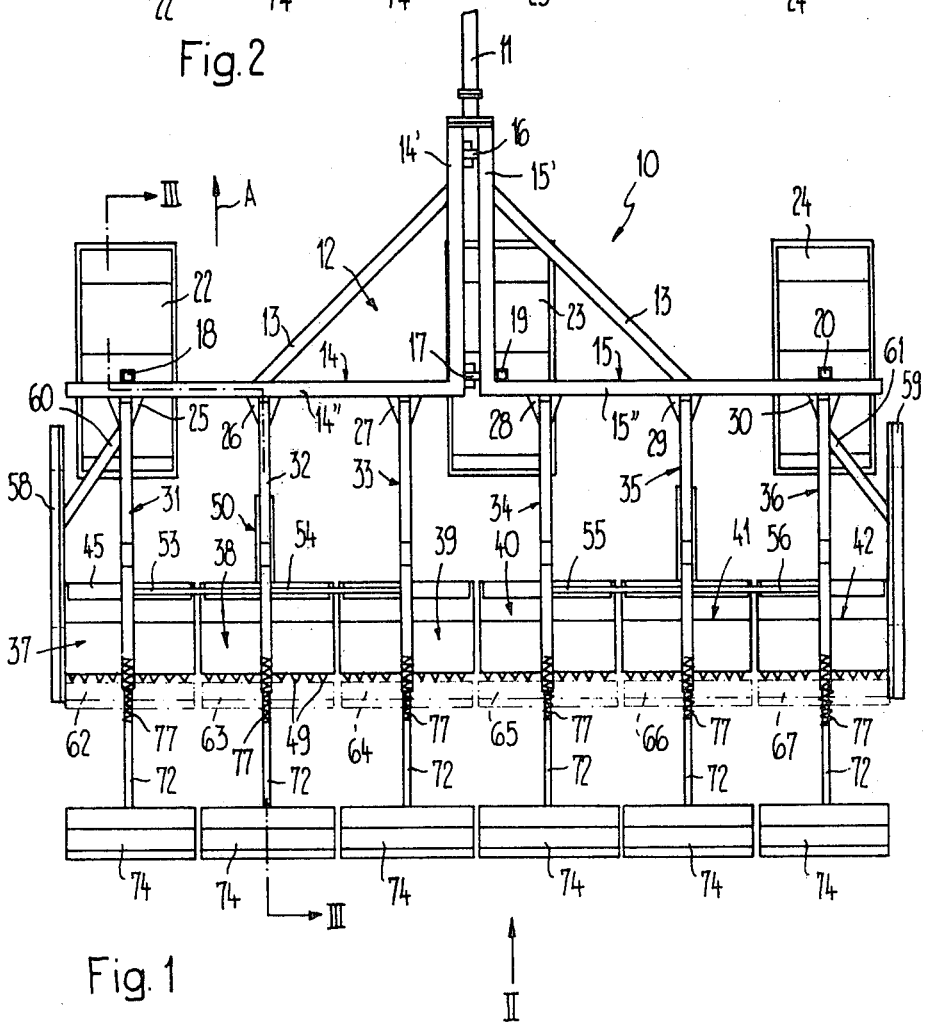
FIG. 1 is a diagrammatic plan view of a device wherein certain parts are shown in broken lines only.

All of the scraper members 37–32 are associated with a scoop 47 which is limited on its sides by generally upright side walls 58, 59 disposed parallel with respect to the direction of travel of the device (FIGS. 1, 2). Each of the side walls 58, 59 is coupled with the adjacent shank 14'', 15'' respectively, by means of transverse struts 60,61 such that each side wall is movable within its plane so as to follow irregularities of the terrain. At the rear or trailing end, the space of the scoop 57 is limited by a set of shields 62–67 which are of an identical configuration and arrangement, each associated with one of the scraper members 37–42 and having generally the same width.

As can be seen from FIGS. 3–5, the shields (only shield 63 is shown in operation) are arcuately curved, namely about an axis of curvature extending perpendicularly to the direction of travel of the device and parallel with the snow surface over which the device travels. Thus, each shield has a concave side or face referred to with reference numeral 163 in FIGS. 3–5, and a convex side or face 263.

Figure 6:
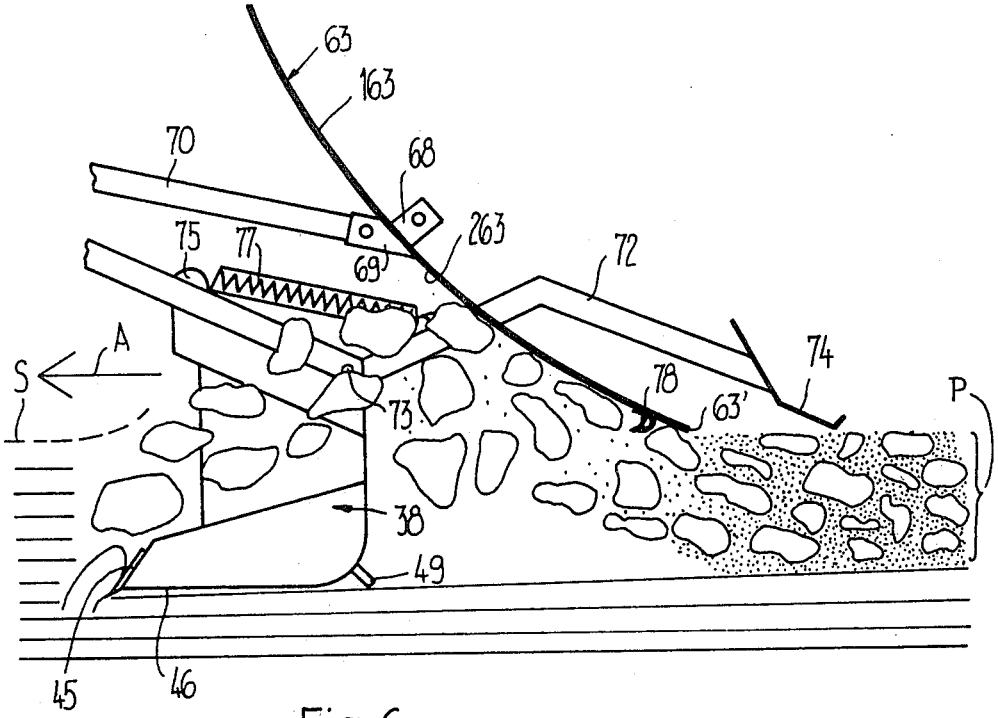
FIG. 6 is a part of the section according to FIG. 5 on an enlarged scale, in order to explain the operation of the device in such position.
Figure 7:
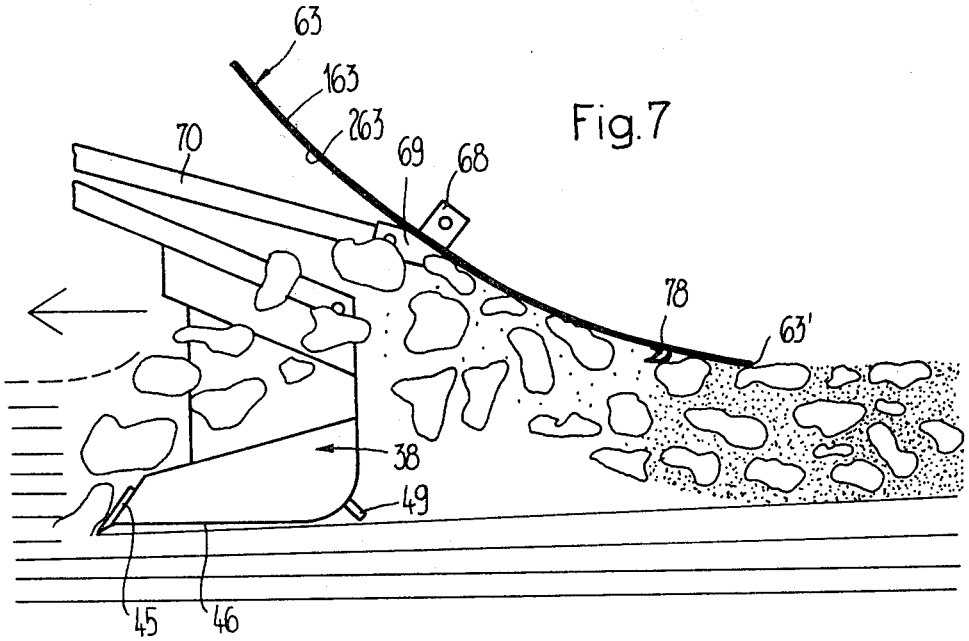
FIG. 7 is a representation similar to FIG. 6 but showing a variant of the embodiment.

As shown in FIGs. 6 and 7, both on the concave and on the convex side or surface of each of the shields 62–67 is fixedly secured a mounting socket, the mounting sockets for the shield 63 being referred to with reference numeral 68 and 39, respectively. The mounting socket 68 is disposed approximately at right angles with respect to the concave surface 163, while the mounting socket 69 forms an obtuse angle with respect to the mounting socket 68. The mounting sockets 68, 69 serve the purpose of fixedly securing the respective shield 63 either with its concave surface 163 turned in the direction of travel of the device (FIG. 3, 4) or with the convex surface turned in the direction of travel of the device (shown in FIG. 5), the securement being effected by securement bolts (not shown) to an arm 70. The arm 70 is fixedly secured, at 71 directly to the first (forward) link of the respective elbow lever 32, in proximity of the elbow joint 44, such that it forms a rearwardly protruding extension of the first link extending over the elbow joint 44.

On comparing FIG. 3 and FIG. 4, it can be seen that, for instance, on adjusting the extension or angular position of the elbow lever 32 by means of the unit 50, the shield 63 can be lifted relative to the scraper member 38. If the pivot pin 43 remains at the same level, the scraper member 38 will then be lifted such that its scraper blade 35 is displaced from engagement with the snow, while the breaker teeth 49, on the other hand, are brought into contact with the snow surface S.

Furthermore, a comparison of FIGS. 3, 4 on the one hand, with FIG. 5 on the other, shows that when the shield 63 is secured to the arm 70 such that its concave side 163 is turned in the direction of travel of the device. With the concave face 163 facing forwards, the shield operates as a closing gate of the scoop region (in FIG. 3, the gate is shown in a closed state, in FIG. 4 in an open state).

If, on the contrary, the shield 63 is secured to the arm 70 with its convex side 263 turned in the direction of travel of the device (shown in FIG. 5), then it operates as a spreading or grading shield. In the position according to FIG. 3 (closed scoop section), the snow accumulated therein can be transported for improvement of another spot of the skiing trail or the like. If the pivot axis 43 is lowered from the position shown in FIG. 3, i.e. the leg 18 is shortened without modifying the state of the elbow lever 32, then the position of FIG. 5 is arrived at, with the shield 63 shown in broken line. The scraper member 38 then engages, depending on the degree of elevation of the pivot axis 42, into the snow layer and "shaves off" same a layer whereby the scraped off snow accumulates within the scoop section 57.

In the position according to FIG. 4 (upwardly turned scraper member), the breaker teeth 49 scrape the surface of the snow and the snow that might be accumulated in the scoop discharges over the scraping member 38 backwards.

An angular arm 72 is secured at its forward end to the rear end of the second link of the elbow lever 32, at 73, for pivotal movement, the arm 72 carrying at its rear end, a further grading shield 74. By means of a pressure spring 72 supported at 75 on the rear link of the elbow lever and at 76 on the angular part 72, the grader shield 74 is constantly maintained in contact with the snow surface under a pressure. It is apparent from FIG. 1 that to each of the scraping members 37–42 is allocated one angular arm 72 prestressed by the spring 77 and carrying one grader shield 74.

Thus, in the position of FIG. 4, the scraped snow surface or snow removed from same can be again deposited on the surface and graded or smoothened.

With respect to the operating position of the device shown in FIG. 5, reference may also be had to FIG. 6. In this figure, the pivot axis 43 is shown in a lowered position. The scraping member 38 (showing here a representation of the position of all of the scraping elements 37–42) breaks the treated snow surface at a predetermined depth and the resulting snow lumps together with looser snow obtained from lower strata of the snow layer, are elevated and flow over the scraper base 38 backwards. This, naturally, depends on the speed of movement of the device. Thus, the snow lumps and looser particles impinge against the shield 63 secured to the arm 70, thereby, apart from the snow lumps being broken-up by the impact, the breaker teeth 78 can also be utilized. They are fixedly secured at a uniform transverse spacing from each other to the convex surface 263 near the spreading edge 63'. In any event, an intermixing of the loose, fine grain snow and of coarer snow particles or lumps takes place prior to the deposition of same back onto the ground. Following the impact onto the shield 63, the whole mass is again slidably pressed onto the ground and the grading shield 74 smoothens inaccuracies that may still be present. Thus, a trail is provided with a very durable "wear" surface P having a good wear resistance and supporting features and a relatively great depth which, as has been established by experiment, maintains good surface qualities even on a very strong use by the skiers over an extended period of time, without breaking up and without the formation of undesired moguls.

As is apparent from FIG. 7, depending on the quality of the processed snow surface, the shield 63 can itself suffice for the grooming of the skiing slopes or the like. In both cases, the snow particles scraped off the surface of the slope, trail or the like, which do not become fully disintegrated, are deposited in the fashion of a mosaic particle embedded in snow received from the lower layers of the treated snow surface. Thereupon, the mixture is compacted and smoothened to provide a wear resistant trail.

It is to be also mentioned that the device in the arrangement of FIG. 5 with the shield 63 disposed in the arrangement shown in broken line serves the purpose of removing from the groomed snow surface a layer and then, in a mode according to FIG. 3 (elevated position of the pivot axis 43 by extension of the leg 18) to transport same to a damaged surface at which the depth of snow is not sufficient, in order to produce a solid trail.

Those skilled in the art will readily appreciate that many further modifications of the device may exist which depart from the preferred embodiment described above, without departing from the scope of one or more of the accompanying claims.

I claim:

1. A snow treatment apparatus for grooming skiing trails, slopes or the like as the apparatus travels on the treated surface, with at least one trailing scraper member freely swingable in a vertical plane, said scraper member including a scraper blade and a normally downwardly facing scraper base adjacent to the former and disposed at an acute angle relative to same, the angle of the scraper base relative to the treated snow surface being adjustable from a working position in which the scraper member scrapes snow off the surface, to a sliding position, in which the scraper base slides on the treated surface, a scoop being associated with the scraper member and being limited by two upright side walls parallel with the direction of travel of the apparatus, and by at least one shield adapted to be lowered towards and lifted away from the scraper member by means of at least one lifting arm in order to collect within the scoop the snow removed by the scraper member, to transport same and then to discharge same; wherein the shield is arcuately curved about a generally horizontal axis extending transversely of the direction of travel of the apparatus, whereby the shield has a convex face and a concave face, said shield being adapted for securement to the respective arm in selective fashion either with its concave or with its convex face turned in the direction of travel of the apparatus.

2. Apparatus according to claim 1, wherein a mounting socket is fixedly secured to each of the convex and concave face of the shield, by which the shield can be slipped onto a free end of the arm and locked with respect to same.

3. Apparatus according to claim 2, wherein the mounting socket secured to the concave face of the shield extends generally in the direction of radius of curvature of the shield such that a lower edge of the shield secured by the said mounting socket to the arm rests on a trailing end portion of the scraper member when the arm is in a lowered position.

4. Apparatus according to claim 3, wherein the mounting sockets are disposed at an obtuse angle relative to each other.

5. Apparatus according to claim 3 wherein, with the shield secured to the arm with its convex face turned in the direction of travel, and with the arm lowered, a lower edge of the shield rests on the snow surface at a spacing rearwards from the scraper member relative to the direction of travel of the device.

6. Apparatus according to claim 3, wherein the shield secured to the arm with the concave face turned in the direction of travel of the apparatus, the an axis of pivot of the trailing scraper member.

7. Apparatus according to claim 1 or 2, wherein said arm is an extension of a first link of an elbow lever and extends rearwards over an elbow joint of said lever, said first link being pivotable at a leading end thereof about a generally horizontal axis perpendicular relative to the direction of travel, said elbow lever further comprising a second link pivotal relative to the first link at said elbow joint, said scraper member being fixedly secured to said second link, said elbow lever further comprising a control mechanism for selective adjustment of the angle between the links at the elbow joint and for maintaining such adjustment.

8. Apparatus according to claim 5 or 6, wherein the scraper base is provided at a trailing end portion thereof with breaker prongs having free ends disposed in a generally coplanar relationship with the scraper base.

9. Apparatus according to claim 5, wherein a plurality of paring blades is provided on said convex face near said lower edge resting on the surface.

10. Apparatus according to claim 9, characterized in that the paring blades are disposed in a generally horizontal row at a generally equidistant spacing from each other.

11. Apparatus adapted to travel on a snow surface for grooming the surface of skiing slopes, trails or the like, having at least one trailing scraper secured to pulling means, said pulling means being pivotal about a horizontal axis perpendicular to the direction of travel, said scraper being provided with a scraper blade and including means for adjusting the angle at which the blade engages the snow surface, the device being provided with a shield disposed at the trailing end of the scraper and connected to the pulling means, wherein the pulling means includes an elbow lever comprised of a front link, a rear link, an elbow joint pivotally connecting the links, and adjustment means for maintaining the links in a selectively adjusted angular position, the forward link being pivotally secured for movement about a normally horizontal, transverse pivot axis disposed at the end of the front link remote from the elbow joint and located at a leading end of the elbow lever relative to the travel of the device, elevation adjustment means for selectively adjusting the level of the pivot axis; an extension member protruding rearwards from the front link over the elbow joint and carrying a trailing end thereof a shield of the type of a grading blade having a lower spreading edge, said scraper being secured to said rear link, whereby said scraper blade and said spreading edge can swing in common about said pivot axis.

12. A device according to claim 11 wherein the shield is provided with paring blades disposed near the spreading edge, for additional disintegration of snow lumps thrown from the scraper and impinging upon the shield as the device travels on the surface.

13. A method of operating an apparatus adapted to travel on a snow surface for grooming the surface of skiing slopes, trails or the like, having at least one trailing scraper secured to pulling means, said pulling means being pivotal about a horizontal axis perpendicular to the direction of travel, said scraper being provided with a scraper blade and including means for adjusting the angle at which the blade engages the snow surface, the device being provided with a shield disposed at the trailing end of the scraper and connected to the pulling means, wherein the pulling means includes an elbow lever comprised of a front link, a rear link, an elbow joint pivotally connecting the links, and adjustment means for maintaining the links in a selectively adjusted angular position, the forward link being pivotally secured for movement about a normally horizontal, transverse pivot axis disposed at the end of the front link remote from the elbow joint and located at a leading end of the elbow lever relative to the travel of the device, elevation adjustment means for selectively adjusting the level of the pivot axis, an extension member protruding rearwards from the front link over the elbow joint and carrying a trailing end thereof a shield of the type of a grading blade having a lower spreading edge, said scraper being secured to said rear link, whereby said scraper blade and said spreading edge can swing in common about said pivot axis; said method being characterized in that the speed of travel and the elevation of said scraper relative to the ground and relative to the elevation of the spreading edge are so adjusted that a layer of snow is cut off from the surface by the scraper, caused to impinge upon the shield and, eventually, deposited on the ground and slidingly pressed onto the surface of the groomed slope, trail or the like.

14. Apparatus for grooming the surface of snow on skiing slopes, trails or the like, of the type adapted for movement on the groomed surface in a predetermined direction, said apparatus including, in combination:

(a) a generally transverse scraper means including a downwardly and forwardly sloping, transverse scraper edge section at a leading end and a generally flat base section normally facing the ground and disposed at an acute angle relative to said edge section;

(b) adjustment means for selectively adjusting the position of said scraper means from a scraping position wherein the base section is generally parallel with the ground and the edge section scrapes off a layer of snow from the ground surface, to a sliding position, wherein the edge section is disposed at vertical spacing above the groomed surface and the base section is sloped downwardly and rearwards for sliding on the surface;

(c) snow scoop means comprised of a pair of opposite upright side walls generally parallel with said predetermined direction, and a transverse trailing end wall means cooperative with the side walls and disposed rearwards of the scraper edge section to define a space for collecting snow removed from the surface by said scraper edge section for transport of same to a predetermined location;

(d) lifting means for selectively lifting or lowering said trailing end wall means to open or close said space, respectively;

(e) said end wall means having the shape of a generally rectangular shield having a generally straight and normally horizontal first edge and a generally straight and normally horizontal second edge, said horizontal edges extending tranversely of the apparatus, and arcuately curved side edges oriented such that one surface of the wall means is convex and the other surface thereof is concave relative to an axis of curvature extending transversely with respect to said movement;

(f) mounting means for securing said shield to said lifting means in selectively alternate fashion with the said axis of curvature disposed ahead of or behind the shield relative to said predetermined direction, said shield sloping downwardly and rearwards when said axis of curvature is disposed behind the shield.

15. Apparatus as claimed in claim 14, wherein said lifting means includes a trailing arm pivotable about a pivot axis generally parallel with said axis of curvature, said mounting means being adapted for securement of the shield to a free end portion of the trailing arm.

16. Apparatus as claimed in claim 14, wherein said mounting means is of the type maintaining, with said lifting means lowered and the axis of curvature ahead of the shield, a first, generally upright position of the shield and, with said lifting means lowered and the axis of curvature behind the shield, a downwardly and rearwardly sloping second position of the shield, whereby the first position is useful in closing said scoop means and the second position is useful in spreading the snow scraped off the groomed surface by said scraper edge section.

17. Apparatus as claimed in claim 14, wherein said lifting means includes a trailing arm pivotable about a pivot axis generally parallel with said axis of curvature, said mounting means being adapted for securement of the shield to a free end portion of the trailing arm, said mounting means being of the type of a plug-nd socket mount, a first portion of which is coincident with said free end portion of the arm, the other portion of the mount including two counter-sections, each complementary with said first portion, one at each surface of the shield, said counter sections being disposed within a common, generally vertical plane parallel with said predetermined direction of movement, said counter sections being disposed at an obtuse angle relative to each other, whereby the degree of inclination of the shield relative to the ground is different depending on which of the two counter sections is secured to said first portion.

18. Apparatus for grooming the surface of snow on skiing slopes, trails or the like, comprising, in combination:

(a) a frame for movement of the device along the surface, in a predetermined direction;

(b) scraper means mounted on said frame means and extending transversely relative to the predetermined direction, generally parallel with the snow surface;

(c) said scraper means having a downwardly and forwardly sloping snow scraping surface;

(d) spreading shield means adapted to be mounted on said frame and including a lower edge portion extending transversely with respect to the predetermined direction, at a location rearwards of said scraper means;

(e) said scraper means being operatively associated with control means for selectively adjusting the angle of engagement of the scraper means with the surface of the snow thus controlling the depth of a snow layer engaged by the scraper means;

(f) mounting means for selectively securing said shield means to said frame with said lower edge maintained at a predetermined level relative to the level of said scraper means;

(g) means for a generally free, trailing pivotal securement of the scraper means and of said shield means to the frame for a generally free swinging movement in common about a common, transverse, generally horizontal pivot axis.

19. Apparatus as claimed in claim 18, wherein scraper means and said shield means are both secured to a trailing arm assembly comprising:

(a) link means including a first link having a leading end freely pivotal generally about said pivot axis, a trailing end of the first link being pivotally secured to a leading end of a second link for relative pivotal movement between the first and second link generally within a vertical plane parallel with said predetermined direction, the second link being fixedly secured to said scraper means;

(b) said spreading shield means being fixedly secured to said first link;

(c) said control means being a device for maintaining a selectively adjustable angular position between the first and second link thus maintaining said lower edge of the shield at the selectively predetermined level relative to said scraper means and simultaneously maintaining said angle of engagement of the scraper means with the surface of the snow.

20. Apparatus as claimed in claim 19, wherein said spreading shield means is secured to one end of a trailing arm, the other, leading end of the trailing arm being fixedly secured to said first link.

21. Apparatus as claimed in claim 20, wherein said shield means is provided with securement means for alternatively securing said shield to said trailing arm in a first position, wherein said trailing arm is at an obtuse angle relative to a downwardly and rearwardly sloping plane generally coincident with said shield, and in a second position wherein the arm is generally at right angles relative to a generally upright plane coincident with the shield.

22. Apparatus as claimed in claim 21, wherein said shield is slightly curved about a horizontal, transverse axis of curvature and thus has a convex surface and a concave surface, the axis of curvature being disposed rearwards and above the shield when the shield is in said first position and forwards of the shield when the shield is in said second position.

23. Apparatus as claimed in claim 21 or 22, further comprising side wall means operatively arranged with said shield in said second position to form therewith a snow storage compartment for snow scraped off the surface by said scraper means.

* * * * *